US006739686B2

(12) United States Patent
Imai

(10) Patent No.: US 6,739,686 B2
(45) Date of Patent: May 25, 2004

(54) INK JET DEVICE

(75) Inventor: Koji Imai, Inuyama (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/301,429

(22) Filed: Nov. 21, 2002

(65) Prior Publication Data

US 2003/0103095 A1 Jun. 5, 2003

(30) Foreign Application Priority Data

Nov. 30, 2001 (JP) ..... P2001-365480

(51) Int. Cl.[7] ..... B41J 29/38
(52) U.S. Cl. ..... 347/10; 347/17
(58) Field of Search ..... 347/5, 10, 14, 347/17, 20, 54, 68, 70, 71, 57–59

(56) References Cited

U.S. PATENT DOCUMENTS 6,416,149 B2 * 7/2002 Takahashi ..... 347/10

* cited by examiner

*Primary Examiner*—Juanita D. Stephens
(74) *Attorney, Agent, or Firm*—Reed Smith LLP

(57) ABSTRACT

An ink jet printer stores a waveform and tables. The tables list voltages in correspondence with each of a predetermined number of consecutive ejection operations from start of a scan row. Each of the plurality of tables corresponds to a different plurality of simultaneously fired actuators. The stored waveform is modified to match the voltage listed in correspondence with the next ink ejection operation in the table that corresponds to the number of actuators that will be simultaneously fired in the next ink ejection operation. Voltage is applied to actuators of a print head based on the modified waveform.

13 Claims, 8 Drawing Sheets

TABLE 1
(50 CHANNELS OR MORE
SIMULTANEOUSLY DRIVEN)

| INK EJECTION OPERATION | DRIVE VOLTAGE (V) |
|---|---|
| 1 | 19.7 |
| 2 | 19.4 |
| 3 | 19.4 |
| 4 | 19.0 |
| 5 | 19.0 |
| 6 | 18.7 |
| 7 | 18.7 |
| 8 | 18.7 |
| 9 | 19.0 |
| 10 | 19.4 |
| 11 | 19.7 |
| 12 | 20.0 |
| 13 | 20.3 |
| 14 | 20.3 |
| 15 | 20.0 |

TABLE 2
(30 TO 49 CHANNELS ARE SIMULTANEOUSLY DRIVEN)

| INK EJECTION OPERATION | DRIVE VOLTAGE (V) |
|---|---|
| 1 | 20.0 |
| 2 | 19.7 |
| 3 | 19.7 |
| 4 | 19.7 |
| 5 | 19.4 |
| 6 | 19.0 |
| 7 | 19.0 |
| 8 | 19.4 |
| 9 | 19.7 |
| 10 | 19.7 |
| 11 | 20.0 |
| 12 | 20.0 |
| 13 | 20.0 |
| 14 | 20.0 |
| 15 | 20.0 |

FIG.11

TABLE 3
(10 TO 29 CHANNELS ARE SIMULTANEOUSLY DRIVEN)

| INK EJECTION OPERATION | DRIVE VOLTAGE (V) |
|---|---|
| 1 | 20.0 |
| 2 | 20.0 |
| 3 | 20.0 |
| 4 | 20.0 |
| 5 | 20.0 |
| 6 | 19.7 |
| 7 | 20.0 |
| 8 | 20.0 |
| 9 | 20.0 |
| 10 | 20.0 |
| 11 | 20.0 |
| 12 | 20.0 |
| 13 | 20.0 |
| 14 | 20.0 |
| 15 | 20.0 |

FIG.12

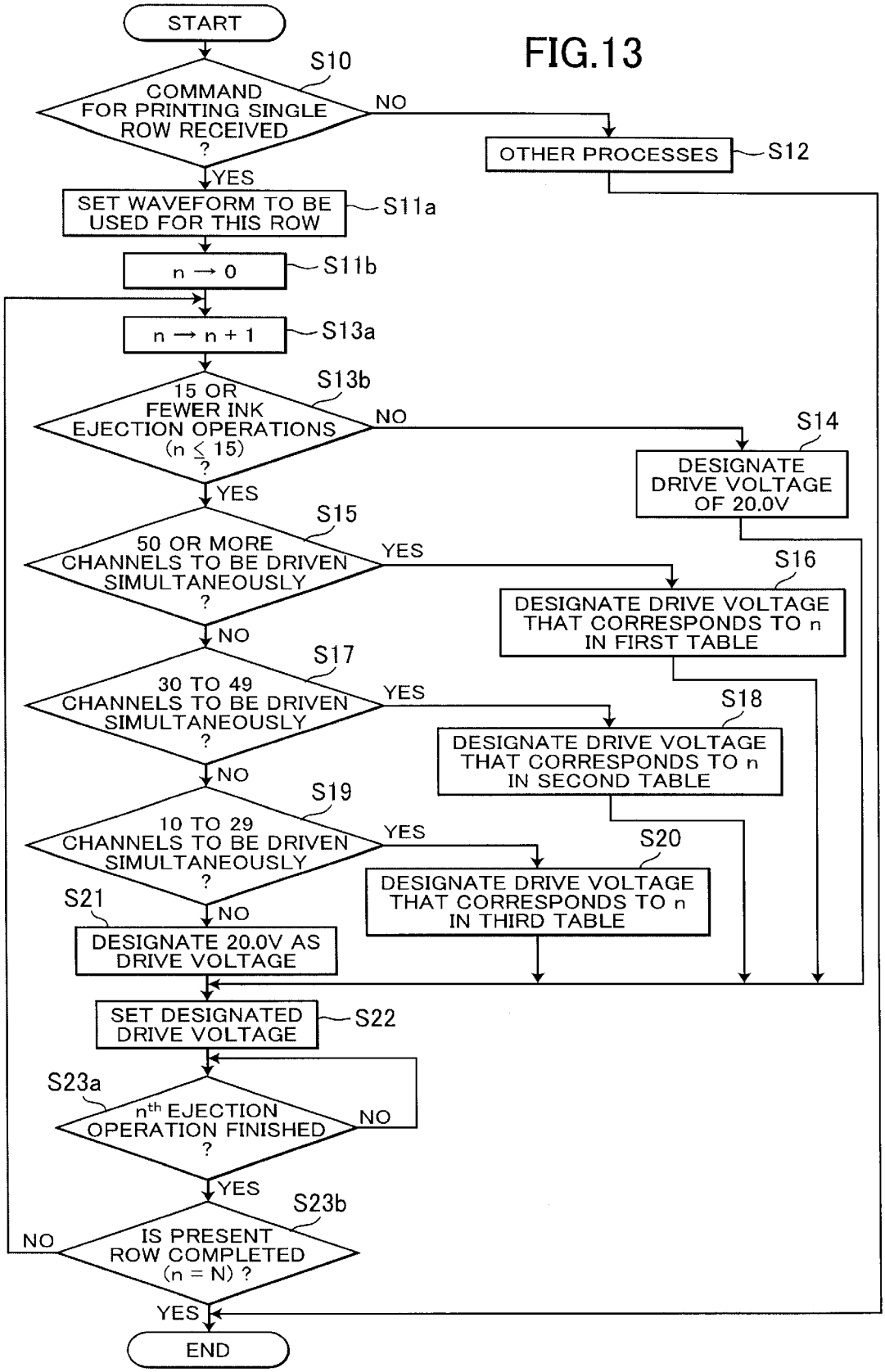
FIG.13
START
S10
COMMAND FOR PRINTING SINGLE ROW RECEIVED ?
NO
OTHER PROCESSES
S12
YES
SET WAVEFORM TO BE USED FOR THIS ROW
S11a
n → 0
S11b
n → n + 1
S13a
S13b
15 OR FEWER INK EJECTION OPERATIONS (n ≤ 15) ?
NO
S14
DESIGNATE DRIVE VOLTAGE OF 20.0V
YES
S15
50 OR MORE CHANNELS TO BE DRIVEN SIMULTANEOUSLY ?
YES
S16
DESIGNATE DRIVE VOLTAGE THAT CORRESPONDS TO n IN FIRST TABLE
NO
S17
30 TO 49 CHANNELS TO BE DRIVEN SIMULTANEOUSLY ?
YES
S18
DESIGNATE DRIVE VOLTAGE THAT CORRESPONDS TO n IN SECOND TABLE
NO
S19
10 TO 29 CHANNELS TO BE DRIVEN SIMULTANEOUSLY ?
YES
S20
DESIGNATE DRIVE VOLTAGE THAT CORRESPONDS TO n IN THIRD TABLE
S21
NO
DESIGNATE 20.0V AS DRIVE VOLTAGE
SET DESIGNATED DRIVE VOLTAGE
S22
S23a
nth EJECTION OPERATION FINISHED ?
NO
YES
S23b
IS PRESENT ROW COMPLETED (n = N) ?
NO
YES
END

INK JET DEVICE

BACKGROUND OF THE INVENTION

1. Field of the Invention

The present invention relates to an ink jet device used in, for example, an ink jet printer.

2. Description of the Related Art

FIG. 1 shows a conventional ink jet head 100 used in an ink jet printer to eject ink droplets. The ink jet head 100 includes a chamber block 103 and a piezoelectric element 122. The chamber block 103 is formed with a pressure chamber 116, a manifold 124, and an ejection nozzle 120. The pressure chamber 116 is filled with ink. The piezoelectric element 122 is fixed on the upper wall of the chamber block 103 and is connected to a drive circuit 110. To eject ink droplets 126 from the ejection nozzle 120, the drive circuit 110 applies a voltage pulse to the piezoelectric element 122 so that the piezoelectric element 122 deforms. The upper wall of the chamber block 103 deforms accordingly as indicated by dotted line in FIG. 1. When the upper wall of the chamber block 103 deforms into the pressure chamber 116 in this manner, the pressure in the pressure chamber 116 increases and pushes ink out from the pressure chamber 116 and the nozzle 120 in the form of ink droplets 126.

In the example of FIG. 1, a drive voltage pulse waveform including three drive pulses is applied to the piezoelectric element 122, so that three ink droplets 126 are ejected in succession. The ink droplets 126 are connected together as shown in FIG. 1 when first ejected from the nozzle 120, but separate during flight. The simplest drive voltage pulse waveform applied by the drive circuit 110 to the piezoelectric element 122 is a single pulse drive waveform configured from only a single drive pulse.

Once the applied voltage reaches a peak value for ejecting the ink droplets 120, it returns to a base voltage whereupon the piezoelectric element 122 and the upper wall of the chamber block 103 return to their initial shape. The pressure in the pressure chamber 116 drops so that ink ejection stops. At the same time, ink is drawn into the pressure chamber 116 from an ink tank (not shown) through the manifold 124.

FIG. 2 shows an ink ejection head 101 that includes a plurality of pressure chambers 116 and nozzles 120. Piezoelectric elements 122 are provided on confronting walls that form the pressure chambers 116. Although not shown in the drawings, a head transport mechanism is provided for transporting the ink ejection head 101 in consecutive rows in a main scan direction, which is perpendicular to the direction in which the pressure chambers 116 and the nozzles 120 are aligned. Also, a sheet transport mechanism is provided for transporting sheets in an auxiliary scan direction, which is parallel to the direction in which the pressure chambers 116 and the nozzles 120 are aligned.

To print images on a print sheet, the head transport mechanism transports the ink ejection head 101 in the main scan direction while the drive circuit 110 applies drive voltage pulses to selective sets of the piezoelectric elements 122 in consecutive ejection operations of the same row. At the end of the first row, the sheet transport mechanism transports the print sheet in the auxiliary scan direction by a distance equivalent to the length of the ink ejection head 101 while the head transport mechanism moves the ink ejection head 101 back to its initial position. Then, the transport mechanism again transports the ink ejection head 101 in the main scan direction to print another row of images.

SUMMARY OF THE INVENTION

The inventor observed that images printed by the ink jet device 101 lack uniformity of image density during the first few millimeters after the ink jet device 101 begins printing a new row of images in the main scan direction. The inventor investigated this problem and discovered that when a plurality of nozzles are fired at the same time soon after start of an image row, abnormal residual pressure fluctuation patterns develop between the manifold that supplies ink into the ink chamber and the ejection nozzle. Further, the inventor discovered that the type of residual pressure fluctuation pattern depends on the number of nozzles that are simultaneously fired. These residual pressure fluctuation patterns influence the volume of ink droplets ejected simultaneously. The resultant dot column in the printed row can appear darker or lighter than surrounding dot columns, depending on whether the volume of the droplets was greater than or less than normal volume. This variation in density of adjacent dot columns can appear as vertical stripes in the first few millimeters of the printed image.

It is an objective of the present invention to overcome the above-described problem and provide an ink jet device that prints with uniform image density throughout the entire print row.

In order to achieve the above-described objectives, an ink ejecting device according to the present invention includes a print head, a scanning mechanism, a drive circuit, and a controlled. The print head includes a plurality of pressure chambers, actuators, and nozzles in a one-to-one correspondence with each other. Each pressure chamber is in fluid communication with a corresponding nozzle and filled with ink. The actuators generate energy upon application of voltage to eject ink from the corresponding pressure chamber through the corresponding nozzle. The scanning mechanism moves the print head to scan in consecutive rows. The drive circuit applies voltage to the actuators.

The controller controls the drive circuit to apply voltage selectively to the actuators to drive the print head to perform consecutive ejection operations while the scanning mechanism scans the print head in each row. The controller generates drive waveforms that compensate for pressure fluctuations in the pressure chambers, for each of a predetermined number of ejection operations from the start of each row that the scanning mechanism scans the print head and applies them to the drive circuit. The controller generates the drive waveforms depending on which of the predetermined number of ejection operations is to be performed next in a present row.

According to another aspect of the present invention, an ink ejecting device includes the print head, the scanning mechanism, and the drive circuit of the first aspect, and further includes a waveform memory, a compensation feature memory, and a different controller. The waveform memory stores a waveform. The compensation feature memory stores features, such as voltage values, pulse widths, and the like, that are used to modify the waveform in the waveform memory in order to compensate for pressure fluctuations in the pressure chambers.

The controller of the second aspect controls the drive. Circuit to apply voltage selectively to the actuators to drive the print head to perform consecutive ejection operations while the scanning mechanism scans the print head in each row. The controller selects a feature from the compensation feature memory for each of a predetermined number of ejection operations from start of each row that the scanning mechanism scans the print head. The controller selects the features depending on which of the predetermined number of ejection operations is to be performed next in a present row, and then uses the selected feature to modify the waveform into a modified waveform. The controller then controls the drive circuit based on the modified waveform for the corresponding ejection operation.

A method according to the present invention involves storing a waveform in a waveform memory and a table in a compensation feature memory. The table lists one type of features such as voltage, pulse width, and the like, in correspondence with each of a predetermined number of consecutive ejection operations from start of a scan row. The waveform stored in the waveform memory is modified based on the feature listed in correspondence with an ink ejection operation to be performed next in a scan row. Then voltage is applied to actuators of a print head based on the modified waveform.

BRIEF DESCRIPTION OF THE DRAWINGS

The above and other objects, features and advantages of the invention will become more apparent from reading the following description of the embodiment taken in connection with the accompanying drawings in which:

FIG. 11 is a schematic view representing a compensating voltage table 2 stored in the voltage table memory area of the ROM shown in FIG. 7;

FIG. 12 is a schematic view representing a compensating voltage table 3 stored in the voltage table memory area of the ROM shown in FIG. 7; and FIG. 13 is a flowchart representing print control performed in the printer.

DETAILED DESCRIPTION OF THE EMBODIMENT

Figure 1:
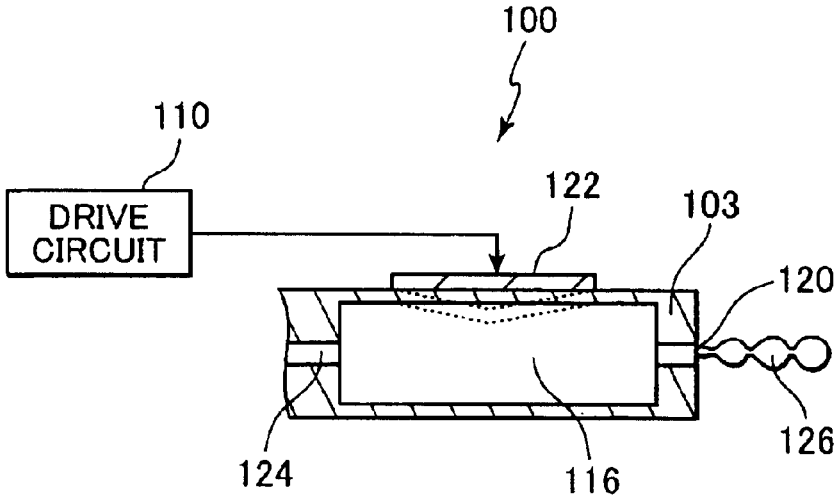
PRIOR ART FIG.1
FIG. 1 is a cross-sectional view showing a conventional ink ejection head.
Figure 2:
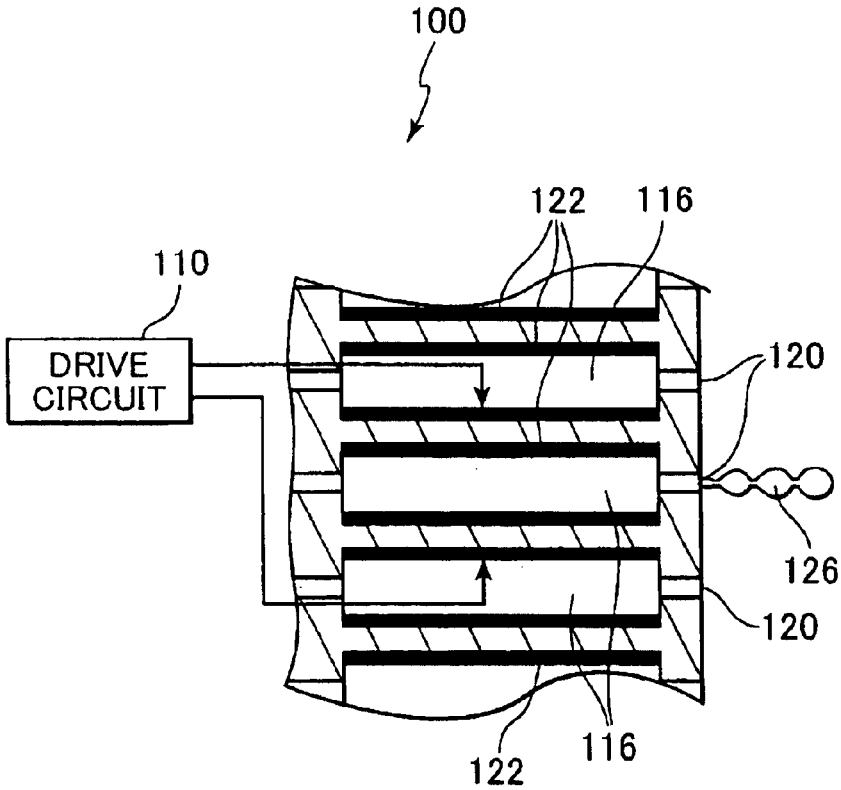
PRIOR ART FIG.2
FIG. 2 is a cross-sectional view showing another conventional ink ejection head.
Figure 3:
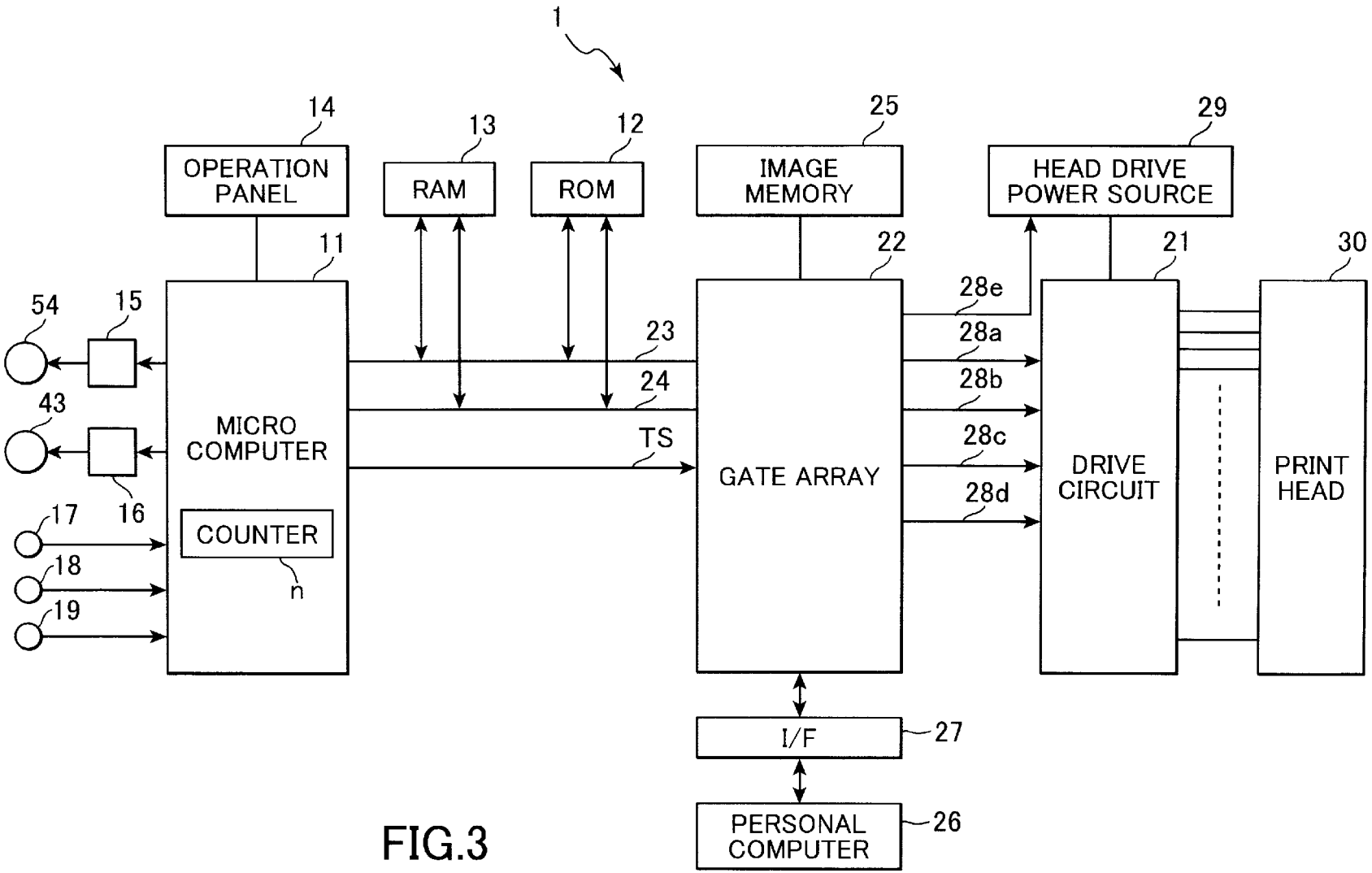
FIG. 3 is a block diagram showing components of an ink jet printer according to an embodiment of the present invention.

Next, an ink jet printer 1 according to an embodiment of the present invention will be described with reference to FIGS. 3 to 13. As shown in FIG. 3, the ink jet printer 1 includes a microcomputer 11 and a gate array 22 connected together by bus lines 23, 24 and an election timing signal line TS. The microcomputer 11 serves as the main controller of the ink jet printer 1 and is connected to an operation panel 14, a carriage motor driver 15, a platen motor driver 16, a paper senior 17, a carriage sensor 18, and a line feed motor sensor 19. The carriage motor driver 15 is for driving a carriage motor 54 to rotate. The platen motor driver 16 is for driving a platen motor 43 to rotate. The operation panel 14 is used by an operator to input various commands to the microcomputer 11. The carriage sensor 18 detects when the carriage is in its initial position. The line feed sensor 19 detects when a line feed motor, cams, and other components are in their initial position. The microcomputer 11 includes a counter n and is also connected to a random access memory (RAM) 13 and a read only memory (ROM) through the bus lines 23, 24. The RAM 13 is for temporarily storing a variety of data and the ROM 12 is for storing print control programs and the like.

The gate array 11 is for processing print data and is connected to an interface 27, an image memory 25, and a drive circuit 21. The interface 27 is connected to the printer port of a personal computer 26 The image memory 25 stores font data and the like. The gate array 22 is also connected to the drive circuit 21 through signal lines 28*a* to 28*d*. The drive circuit 21 is capable of selectively applying one of six voltages 18.7V, 19.0V, 19.4V, 19.7V, 20.0V, and 20.3V individually and selectively to piezoelectric elements 32 of a print head 30 to be described later. The signal line 28*a* transmits data signals from the gate array 22 to the drive circuit 21. The signal line 28*b* transmits a clock for synchronizing transmission of data transmitted over the signal line 28*a*. The signal line 28*c* is for transmitting a strobe signal. The signal line 28*d* transmits an ejection clock for determining the timing of ink ejections. The drive circuit 21 is connected to a head drive power source 29. The gate array 22 is also connected to a head drive power source 29 through a line 28*e* for transmitting control signals from the gate array 22 to the head drive power source 29.

Figure 4:
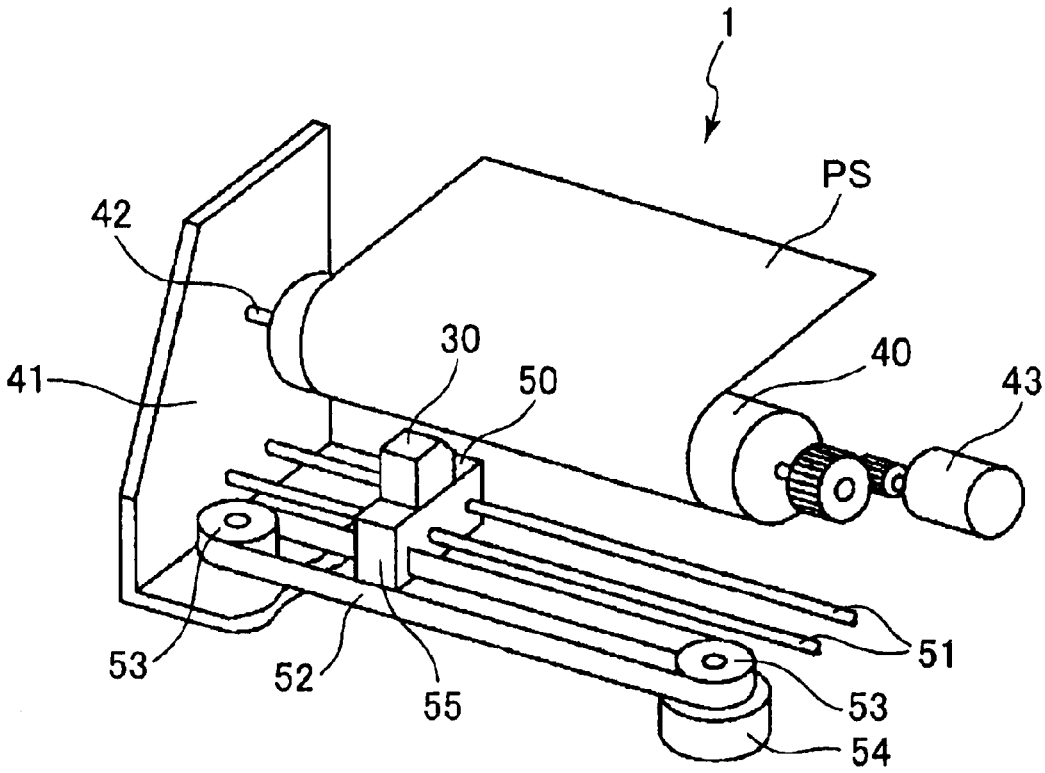
FIG. 4 is a perspective view showing configuration of the ink jet printer for generating relative movement between a print sheet and a print head of the ink jet printer.

As shown in FIG. 4, the ink jet printer 1 further includes configuration for generating relative movement between the print head 30 and a print sheet PS. The configuration includes a platen roller 40 and a carriage 50. The platen roller 40 is rotatably attached to a frame 41 by a shaft 42 and is driven to rotate by the platen motor 43 to transport print sheets PS one at a time past the carriage 50. The carriage 50 is slidably mounted on two guide rods 51, which are oriented in parallel with the rotational axis of the platen roller 40. The carriage 50 is coupled to a timing belt 52, which is wrapped around a pair of pulleys 53. The carriage motor 54 is provided for driving the pulleys 53 in both forward and in reverse directions. The carriage 50 supports the print head 30 and an ink cartridge 55. The print head 30 is oriented in confrontation with the platen roller 40 at a position for printing on the print sheet PS that is set on the platen roller 40. With this configuration, the print head 30 travels reciprocally in consecutive rows in front of the print sheet PS when the carriage motor 54 reciprocally drives the pulleys 53.

Here, operations for printing images on print sheets PS will be described briefly. The print sheet PS is supplied from a sheet supply cassette (not shown) provided to the side of the ink jet printer 1, and transported between the print head 30 and the platen roller 40. Then, the carriage motor 54 rotates in a forward direction to scan the print head 30 horizontally (from left to right) in front of the print sheet PS. This is the start of a first row of images. Once the print head 30 has move a predetermined distance in the first row, then in a first ejection operation the print head 30 is driven based on data from the personal computer 26 to eject ink from selected nozzles of the print head 30 onto the print sheet PS. Once the first ink ejection operation is completed, and the print head 30 has again moved the predetermined distance in the first row by drive of the carriage motor 54, then in a second ink ejection operation of the first row the print head 30 is driven to eject ink from selected nozzles. Ink ejection operations are performed consecutively in this manner until the print head 30 is scanned to the end of the first row. Then, the carriage motor 54 rotates in reverse to scan the print head 30 back to its initial position. During this time, the platen motor 43 is driven to move the platen roller 40 so that the print sheet 30 moves one row's distance in the auxiliary scan direction. Then, the carriage motor 54 is again driven to scan the carriage from left to right and the print head 30 is driven to perform consecutive ink ejection operations to print images in a second row. These processes are repeated until all of the image rows have been recorded on the print sheet PS. Then, the print sheet PS is discharged from the ink jet printer 1. It should be noted that configuration for supplying and discharging the print sheet PS is omitted from FIG. 4.

Figure 5:
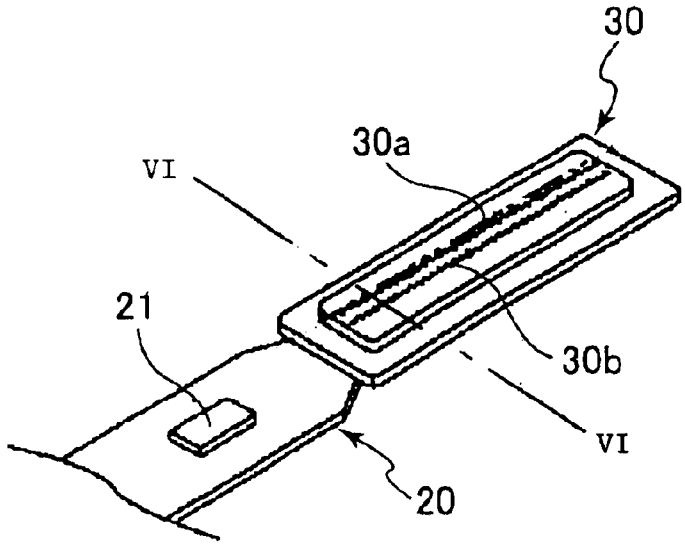
FIG. 5 is a perspective view showing the print head.

As shown in FIG. 5, the print head 30 is formed with two rows 30*a*, 30*b* of ejection nozzles. The print head 30 is supported on the carriage 50 with the nozzle rows aligned with the auxiliary scan direction in which the sheet PS is transported by the platen 40 and platen motor 43. Therefore, each time an ink ejection operation is performed to eject ink simultaneously from a plurality of the nozzles in either of the rows 30*a*, 30*b*, dots corresponding to the fired nozzles are aligned on the print sheet PS in the auxiliary scan direction. A flexible cable 20 is connected to the print head 30. The drive circuit 21 is mounted on the flexible cable 20.

Figure 6:
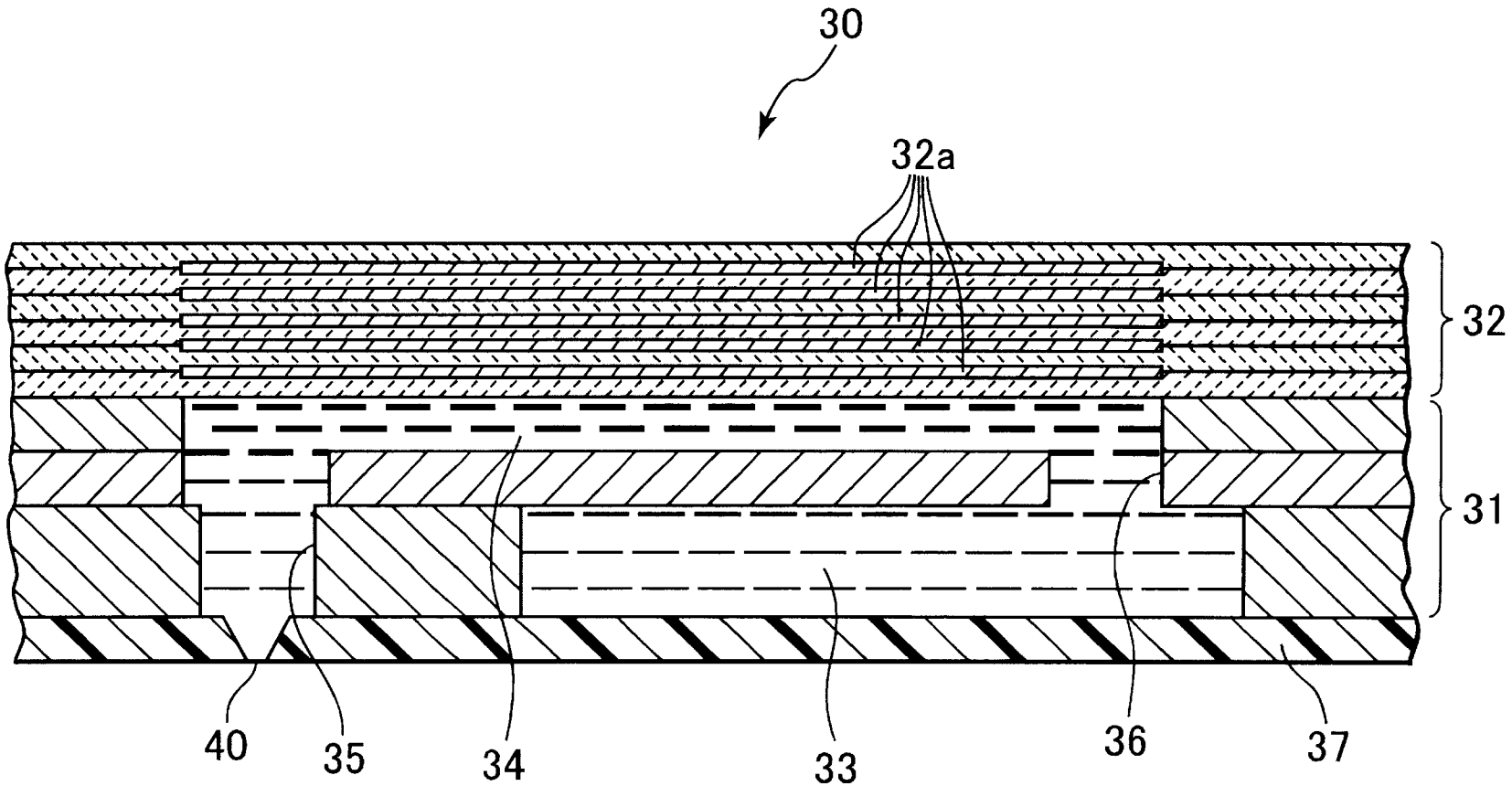
FIG. 6 is a cross-sectional view taken along line VI—VI of FIG. 5.

Next, internal configuration of the print head 30 will be described while referring to FIG. 6. As shown in FIG. 6, the print head 30 includes a cavity plate 31, a piezoelectric element 32, and a nozzle plate 37. The cavity plate 3 is configured from a stack of stainless steel plates. The piezoelectric element 32 is formed from a stack of piezoelectric layers and is mounted on the cavity plate 31.

The nozzle plate 37 is formed with the nozzle rows 30*a*, 30*b*, although only a representative nozzle 40 from the nozzle row 30*a* is shown in FIG. 6. Internal configuration of the print head 30 is the same for each nozzle in the nozzle rows 30*a*, 30*b*, so configuration relating to only the representative nozzle 40 of row 30*a* will be described while referring to FIG. 6. The cavity plate 31 is formed with a manifold 33, a pressure chamber 34, and connecting through holes 35, 36. The connecting through hole 36 brings the manifold 33 into fluid communication with the pressure chamber 34, and the connecting through hole 35 brings the pressure chamber 34 into fluid communication with the corresponding nozzle 40. Electrodes 32*a* are interposed between the piezoelectric layers at positions corresponding to the pressure chambers 34. The center piezoelectric layers are each sandwiched between two of the electrodes 32*a*.

When a drive voltage is applied to a set of electrodes 32*a*, the corresponding portion of the piezoelectric element 32 deforms into the corresponding pressure chamber 34. This increases the pressure in the pressure chamber 34 so that ink filling the pressure chamber 34 is pushed through the through hole 35 and ejected from the corresponding nozzle 40.

Figure 7:
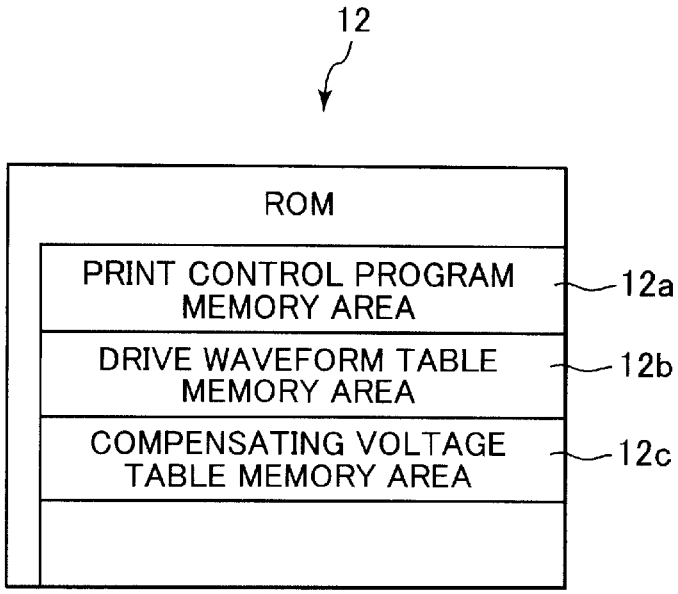
FIG. 7 is a schematic view showing memory areas in a ROM of the printer shown in FIG. 3.

Next, memory areas of the ROM 12 will be described while referring to FIG. 7. As shown in FIG. 7, the ROM 12 is partitioned into a plurality of memory areas, such as a print control program memory area 12*a* that stores print control programs for controlling printing operations of the ink jet printer 1, a drive waveform table memory area 12*b*, and a compensating voltage table memory area 12*c*.

The drive waveform table memory area 12*b* stores a variety of waveforms for pulses to applied by the drive circuit 21 under different temperatures and other conditions of the ink jet printer 1. The drive waveform table memory area 12*b* lists pulse width, pulse height, and interpulse distance for each waveform. The pulse width is the duration of voltage application. The pulse height is the voltage value, and is 20V in the present example. The interpulse distance is delay before a subsequent voltage pulse is applied.

Figures 9, 10:
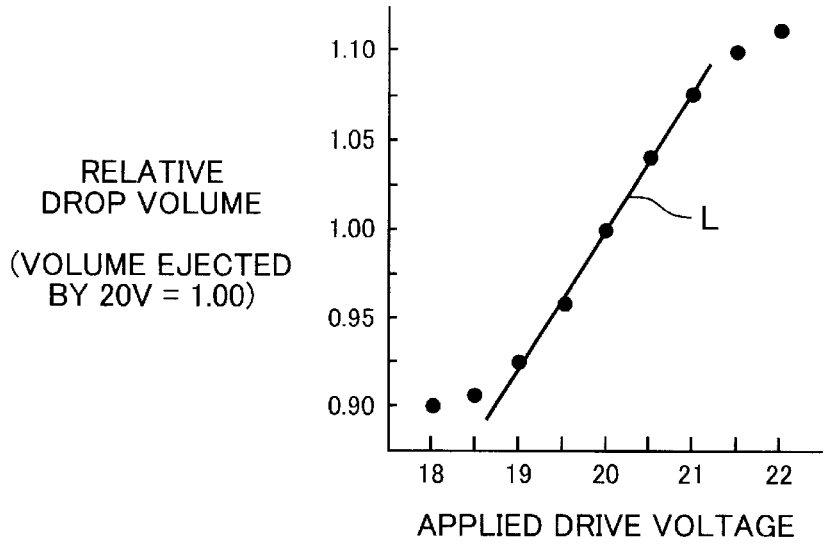
FIG. 9 is a graph showing relative volume of ink droplets ejected by applying different drive voltages.
FIG. 10 is a schematic view representing a compensating voltage table 1 stored in a voltage table memory area of the ROM shown in FIG. 7.

The compensating voltage table memory area 12*c* stores tables 1 to 3 represented in FIGS. 10 to 12. The tables 1 to 3 are used to compensate for fluctuation in droplet volume that can occur at the start of each print row.

Here, the fluctuation in droplet volume at the start of print rows will be explained with reference to an example shown in the graph in FIG. 8. The graph of FIG. 8 shows fluctuation in droplet volume over a series of 18 consecutive ink ejection operations of the print head 30, in the cases where 20, 40, and 60 nozzles (channels) in one of the rows 30*a* or 30*b* of the print head 30 are fired simultaneously.

Figure 8:
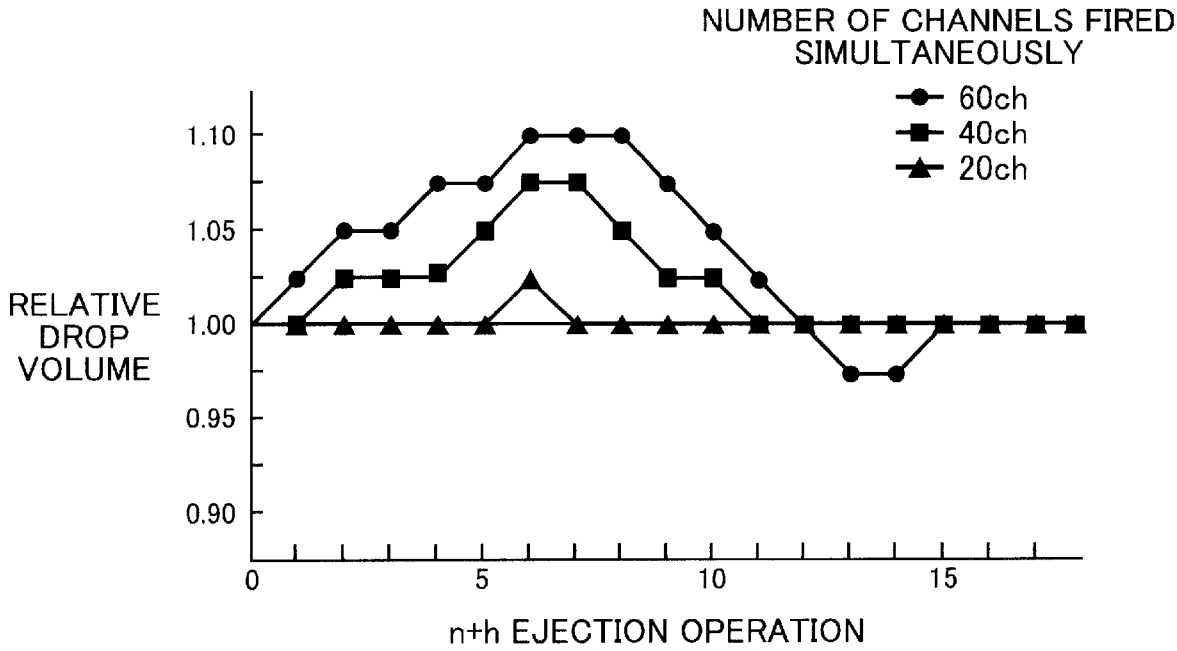
FIG. 8 is a graph showing relationship of the number of ejection operations performed from start of a new print row to fluctuation in ink droplet volume, for different numbers of nozzles fired simultaneously at each ejection operation.

As represented by triangles in FIG. 8, when 20 nozzles (channels) are fired simultaneously, ink droplets ejected of all but the sixth ejection operation have a normal droplet volume 1.0000. Ink droplets ejected at the sixth ejection operation show a relative volume of 1.0250 compared to the normal value 1.0000.

As represented by squares in FIG. 8, when 40 nozzles (channels) are fired simultaneously, the volume of ejected droplets increases and then decreases compared to the reference value 1.0000 over a series of 11 ejection operations of the print head. In more detail, the relative volume of ink droplets is normal at 1.0000 at the first and $11^{th}$ to $18^{th}$ ejection operations, is 1.0250 at the second to fourth, and ninth and tenth ejection operations, is 1.0500 at the fifth and eighth ejection operations, and is 1.0725 at the sixth and seventh ejection operations.

As represented by circles in FIG. 8, when 60 nozzles (channels) are fired simultaneously, the volume of ejected droplets increases to a greater degree than when 40 nozzles (channels) are fired simultaneously, before returning to normal volume at the $12^{th}$ ejection operation of the print head, and then further decreasing and increasing back to normal at the $15^{th}$ ejection operation of the print head. In more detail, the relative volume of ink droplets is normal at 1.0000 at the $12^{th}$ and $15^{th}$ ejection operation, is 1.0250 at the first and $11^{th}$ ejection operation, is 1.0500 at the second, third and $10^{th}$ ejection operation, is 1.0725 at the fourth, fifth, and ninth ejection operation, and is 1.1000 at the sixth to eighth ejection operation of the print head.

The ink jet printer 1 compensates for this fluctuation in drop volume by modifying the drive waveform used by the drive circuit 21 to insure that ink droplets with uniform volume are ejected. The drive waveform is modified by increasing or decreasing the voltage of the pulse applied by the drive circuit 21 to drive the piezoelectric elements 32. As shown in FIG. 9, drop volume can be increased or decreased relative a reference value of 1.0000 by changing the drive voltage. In the example shown in FIG. 9, the droplet volume is the reference value of 1.0000 when drive voltage is 20.0V.

Explained in more detail, relative drop volume is 0.9000 when the drive voltage is 18.0V, relative drop volume is 0.9100 when the drive voltage is 18.5V, relative drop volume is 0.9250 when the drive voltage is 19.0V, relative drop volume is 0.9600 when the drive voltage is 19.5V, relative drop volume is 1.0000 when the drive voltage is 20.0V, relative drop volume is 1.0400 when the drive voltage is 20.5V, relative drop volume is 1.0725 when the drive voltage is 21.0V, relative drop volume is 1.1000 when the drive voltage is 21.5V, and relative drop volume is 1.1100 when the drive voltage is 22.0V.

As shown in FIGS. 10 to 12, the tables 1 to 3 stored in the compensating voltage table memory area 12*c* list a voltage for each of the first 15 ink ejection operations in a print row for when 50 or more nozzles, 30 to 49 nozzles, and 10 to 29 nozzles are fired simultaneously, respectively. The listed voltages are used as the voltage of the drive waveform presently selected from those stored in the drive waveform table memory area 12*b*, in order to compensate for variation in droplet volume, such as that shown in FIG. 8, that can occur when a plurality of nozzles are simultaneously fired. That is, as will be described later with reference to the flowchart of FIG. 13, each time one of the first 15 ink ejection operations of a row includes 10 or more simultaneously fired nozzles, then the waveform of the drive pulse to be used during that ink ejection operation is modified to the voltage listed in the corresponding table in correspondence with the present number ink ejection operation.

The tables 1 to 3 are prepared based on observed variation in relative ejected droplet volume, such as shown in FIG. 8, and on the relation between voltage value and relative drop volume, such as shown in FIG. 9. Here, as an example, the drive voltage to be applied by the drive circuit 21 at the sixth ejection operation when 20 nozzles are fired simultaneously will be calculated. As shown in FIG. 8, an ink droplet ejected at the sixth ejection operation has a relative volume of 1.0250. Therefore, first the value for reducing the relative volume 1.0250 to the normal value of 1.0000 is determined by dividing one by the relative volume 1.0250 (i.e., 1/1.0250=0.9756). Next, the optimum drive voltage for reducing drop volume by the desired amount 0.9756 is determined by interpolation of known drive voltages and corresponding relative drop volumes. That is, as indicated by line L in FIG. 9, ink droplet volume changes in a substantially linear manner in association with change in drive voltage between 19.0V and 21.0V. Therefore, the optimum drive voltage can be easily determined by interpolation. Next, the calculated optimum drive voltage is compared with six voltages (18.7V, 19.0V, 19.4V, 19.7V, 20.0V, and 20.3V) that the drive circuit 21 can apply to piezoelectric elements 32. The closest of the six voltages to the optimum drive voltage in this example is 19.7V. Therefore, 19.7V is added for the sixth ejection operation in table 3 as shown in FIG. 12.

Next, printing control operations performed in the printer 1 will be described with reference to the flowchart of FIG. 13 When a print command for printing one row in received from the personal computer 26 (S10:YES), then in S11*a* the print waveform that corresponds to the present temperature and the like is retrieved from the drive waveform table memory area 12*b* and the corresponding pulse width and the like are set for all pulses used in the present row. Next, the counter n is reset to zero in S11*b* and incremented by one in S13*a*. In S13*b*, it is judged whether the print head 30 is to perform an ink ejection operation near the start of the present row. That is, in S13*b*, whether the print head 30 has performed 15 or fewer consecutive ejection operations is determined by referring to the counter n. If n is greater than 15 (S13*b*:NO), then it is judged that the present ink ejection operation is not directly after the start of the present row, so in S14 the drive voltage to be applied to the electrodes 32 of the print head 30 is set to the standard voltage of 20.0V. In the present example, however, printing operations for the present row have just started and the present ink ejection operation is the first ink ejection operation (n=1). Therefore, the program proceeds to S15.

In S15, it is judged based on the data from the personal computer 26 whether the 50 or more channels (nozzles) of the print head 30 are to be simultaneously driven in the present ink ejection operation. If so (S15:YES), then in S16 the drive voltage listed for the present ink ejection operation is retrieved from table 1 of the compensating voltage table memory area 12*c* and designated as the drive voltage to be applied to the electrodes 32*a* of the print head 30. In the present example, this in the first ink ejection operation of the present row. Therefore, in S16 the drive voltage would designated as 19.7V because as shown in FIG. 10 table 1 lists a drive voltage of 19.7V in correspondence with the first ink ejection operation.

On the other hand, if 30 to 49 channels (nozzles) of the print head 30 are to be simultaneously driven in the present ink ejection operation (S15:NO;S17:YES), then in S18 the drive voltage listed for the present ink ejection operation is retrieved from table 2 of the compensating voltage table memory area 12*c* and designated as the drive voltage to be applied to the electrodes 32*a* of the print head 30. As shown in FIG. 11, the table 2 lists a drive voltage of 20.0V in correspondence with the first ink ejection operation. Therefore, in the present example the drive voltage would be designated as 20.0V in S18.

If the data from the personal computer 26 indicates that 10 to 29 channels (nozzles) of the print head 30 are to be simultaneously driven in the present ink ejection operation (S15:NO;S17:NO;S19:YES), then in S20 the drive voltage listed for the present ink ejection operation is retrieved from the table 3 of the compensating voltage table memory area 12*c* and designated as the drive voltage to be applied to the electrodes 32*a* of the print head 30. As shown in FIG. 12, the table 3 lists a drive voltage of 20.0V in correspondence with the first ink ejection operation. Therefore, in the present example the drive voltage would be designated as 20.0V in S20.

If less than 10 channels are to be driven simultaneously (S15:NO;S17:NO;S19:NO), then in S21 the drive voltage applied to the electrodes 32*a* of the print head 30 is designated as 20.0V.

In S22, the designated drive voltage is set as the drive voltage to be applied by the drive circuit 21. Next, whether the present ejection operation has been completed is determined in S23*a*. Once the present ejection operation is finished (S23*a*:YES), then whether the present row of printing has been completed is determined in S23*b* by checking whether the counter n equals the total number of ink ejection operations N in a row. If not (S23*b*:NO), then the processes of S13*b* to S22 are repeated until the entire present row is printed. In the present example, only the first ejection operation of the present row has been completed (S23*b*:NO) so the processes of S13*b* to S22 are repeated for the second and following ink ejection operations. Once all ink ejection operations of the present row are performed (S23*b*:YES) then the processes for printing this row are finished. If a command other than a row print command is received (S10:NO), then the processes, such as sheet feed processes, that correspond to the command are performed.

In this way, when 15 or fewer ink ejection operations have been performed for the present print row, then the drive voltage to be applied to the electrodes 32*a* of the print head is set for each ink ejection operation in accordance with the number of channels that are to be simultaneously drive by referring to the compensating voltage tables stored in the compensating voltage table memory area 12*c* of the ROM 12. Therefore, even if a plurality of channels are driven simultaneously, adverse effects of the residual pressure fluctuations from the manifold 33 to the ejection nozzles 30*a* can be prevented so that vertical stripes due to variation in image density directly after the start of printing can be prevented.

While the invention has been described in detail with reference to specific embodiments thereof, it would be apparent to those skilled in the art that various changes and modifications may be made therein without departing from the spirit of the invention, the scope of which is defined by the attached claims.

For example, the print head 30 of the embodiment uses piezoelectric elements as actuators that apply pressure for ejecting ink in the ink chambers through the nozzles. However, any type of actuator that can generate energy for ejecting the ink in the ink chambers through the corresponding nozzle can be used instead.

Also, the embodiment describes modifying the pulse height of a waveform to adjust the volume of ejected droplets and compensate for pressure fluctuations. However, any feature of the drive waveform can be modified to adjust the volume of ejected droplets. For example, the drive waveforms can have different rising edges, lower edges, or, when the waveform includes a plurality of pulse, interpulse distances.

What is claimed is:

1. An ink ejecting device that ejects ink, the ink ejecting device comprising:

a print head including a plurality of pressure chambers, actuators, and nozzles in a one-to-one correspondence with each other, each pressure chamber being in fluid communication with a corresponding nozzle and filled with ink, the actuators generating energy upon application of voltage to eject ink from the corresponding pressure chamber through the corresponding nozzle;

a scanning mechanism that moves the print head to scan in consecutive rows;

a drive circuit that applies voltage to the actuators; and a controller that controls the drive circuit to apply voltage selectively to the actuators to drive the print head to perform consecutive ejection operations while the scanning mechanism scans the print head in each row, the controller generating, in order to compensate for pressure fluctuations in the pressure chambers, drive waveforms used by the drive circuit for each of a predetermined number of ejection operations from the start of each row that the scanning mechanism scans the print head, the controller generating drive waveforms depending on which of the predetermined number of ejection operations is to be performed next in a present row.

2. An ink ejecting device as claimed in claim 1, further comprising a new row start determiner that determines when the scanning mechanisms begins scanning the print head in a new row; and an ejection operation counter that counts number of ejection operations performed in the new row determined by the new row start determiner and that indicates a next ejection operation, the controller generating a drive waveform that depends on the next ejection operation indicated by the ejection operation counter for each ejection operation until the ejection operation counter counts more than the predetermined number of ejection operations from the start of the new row.

3. An ink ejecting device as claimed in claim 1, wherein the controller generates different waveforms depending on how many actuators will be driven simultaneously in each ejection operation.

4. An ink ejecting device as claimed in claim 3, wherein the controller generates drive waveforms with voltage values that depend on how many actuators will be driven simultaneously in each ejection operation.

5. An ink ejecting device as claimed in claim 1, further comprising a simultaneous number determiner that determines how many actuators will be driven simultaneously in each ejection operation, the controller generating waveforms that depend on how many actuators that the simultaneous number determiner determines will be driven simultaneously.

6. An ink ejecting device as claimed in claim 5, wherein the controller generates drive waveforms with voltage values that depend on how many actuators will be driven simultaneously in each ejection operation.

7. An ink ejecting device that ejects ink, the ink ejecting device comprising:

a print head including a plurality of pressure chambers, actuators, and nozzles in a one-to-one correspondence with each other, each pressure chamber being in fluid communication with a corresponding nozzle and filled with ink, the actuators generating energy upon application of voltage to eject ink from the corresponding pressure chamber through the corresponding nozzle;

a scanning mechanism that moves the print head to scan in consecutive rows;

a drive circuit that applies voltage to the actuators;

a waveform memory that stores a waveform;

a compensation feature memory that stores features that are used to modify the waveform in the waveform memory in order to compensate for pressure fluctuations in the pressure chambers; and a controller that controls the drive circuit to apply voltage selectively to the actuators to drive the print head to perform consecutive ejection operations while the scanning mechanism scans the print head in each row, the controller selecting a feature from the compensation feature memory for each of a predetermined number of ejection operations from start of each row that the scanning mechanism scans the print head, the controller selecting the features depending on which of the predetermined number of ejection operations is to be performed next in a present row and using the selected feature to modify the waveform into a modified waveform, the controller controlling the drive circuit based on the modified waveform for a corresponding ejection operation.

8. An ink ejecting device as claimed in claim 7, further comprising a simultaneous number determiner that determines how many actuators will be driven simultaneously in each ejection operation, the controller selecting the features further depending on how many actuators that the simultaneous number determiner determines will be driven simultaneously in a present ejection operation of the present row.

9. An ink ejecting device as claimed in claim 8, wherein the compensation feature memory stores a plurality of feature sets that correspond to different numbers of simultaneously driven actuators, each feature set including features for each of the predetermined number of consecutive ejection operations, the controller modifying the waveform using a feature that corresponds to a next ejection operation in the present row and that is included in a feature set that corresponds to a number of simultaneously driven actuators determined by the simultaneous number determiner.

10. An ink ejecting device as claimed in claim 7, further comprising:

a new row start determiner that determines when the scanning mechanisms begins scanning the print head in a new row; and an ejection operation counter that counts number of ejection operations performed in the new row determined by the new row start determiner and that indicates a next ejection operation, the controller modifying the waveform depending on the next ejection operation indicated by the ejection operation counter for each ejection operation until the ejection operation counter counts more than the predetermined number of ejection operations from the start of the new row.

11. An ink ejecting device an claimed in claim 7, wherein the waveform memory stores a plurality of waveforms corresponding to a plurality of different conditions, the controller selecting a waveform from the plurality of waveforms depending on conditions during the present row and modifying the waveform for the predetermined number of ejection operations from the start of the present row.

12. A method of driving an ink ejection device comprising:

storing a waveform in a waveform memory;

storing a table in a compensation feature memory, the table listing a feature in correspondence with each of a predetermined number of consecutive ejection operations from start of a scan row;

modifying the waveform based on the feature listed in correspondence with an ink ejection operation to be performed next in a scan row; and applying voltage to actuators of a print head based on the modified waveform.

13. A method as claimed in claim 12, wherein the step of storing the table in the compensation feature memory includes storing a plurality of tables that list a different set of features depending on number of actuators in the print head to be driven simultaneously and further comprising selecting a table that corresponds to number of actuators in the print head to be driven simultaneously in a next ejection operation and modifying the waveform based on features listed in the selected table.

* * * * *